US012466622B1

(12) United States Patent
Teng et al.

(10) Patent No.: US 12,466,622 B1
(45) Date of Patent: Nov. 11, 2025

(54) AROMATIC WATER CUP

(71) Applicant: Da Teng, Shenzhen (CN)

(72) Inventors: Da Teng, Shenzhen (CN); Liqun Jiang, Shenzhen (CN); Zebao Ouyang, Shenzhen (CN)

(73) Assignee: Da Teng, Guangdong (CN)

( * ) Notice: Subject to any disclaimer, the term of this patent is extended or adjusted under 35 U.S.C. 154(b) by 0 days.

(21) Appl. No.: 19/218,461

(22) Filed: May 26, 2025

(51) Int. Cl.

| | |
|---|---|
| ***B65D 51/28*** | (2006.01) |
| ***A45F 3/00*** | (2006.01) |
| ***A45F 3/18*** | (2006.01) |
| ***B65D 47/14*** | (2006.01) |

(52) U.S. Cl.
CPC ..... *B65D 51/28* (2013.01); *A45F 3/18* (2013.01); *B65D 47/14* (2013.01); *A45F 2003/003* (2013.01)

(58) Field of Classification Search
CPC ..... B65D 51/28; B65D 51/24; B65D 51/18; B65D 47/14; A45F 3/18; A45F 2003/003
USPC ..... 215/227; 220/254.1, 253
See application file for complete search history.

(56) References Cited

U.S. PATENT DOCUMENTS 3,043,464 A * 7/1962 Cerasari ..... A61J 11/045 215/11.1
11,534,372 B2 * 12/2022 Xing ..... A61J 9/08
2013/0302477 A1 * 11/2013 Salinas ..... B65D 51/28 426/115
2019/0367230 A1 * 12/2019 Griffis ..... B65D 47/243
2020/0178712 A1 * 6/2020 Jäger ..... B65D 23/12
2025/0108965 A1 * 4/2025 Chambers ..... B65D 47/12

FOREIGN PATENT DOCUMENTS

CN 219249780 U * 6/2023 ..... A47G 19/22
CN 119734920 A * 4/2025 ..... B65D 23/00

* cited by examiner

*Primary Examiner* — Don M Anderson
*Assistant Examiner* — Eric C Baldrighi
(74) *Attorney, Agent, or Firm* — Ming Jiang; OPENPTO US LLC

(57) ABSTRACT

An aromatic water cup includes a cup body with an inner cavity and a cup head connected thereto. A cylindrical tube with a flow channel is arranged on the cup head. A cup cover is mounted on the cup head, forming a storage chamber between them, in which an aromatic block is placed. The cylindrical tube passes through the cup cover, with the storage chamber surrounding its outer periphery. The cup cover includes an air outlet hole, and a rotating disk with a vent hole is provided on the cover. When the vent hole aligns with the air outlet hole, the cup cover enters a venting state, allowing fragrance from the aromatic block to be released outward. When misaligned, the rotating disk seals the air outlet hole, placing the cup cover in a sealed state, and retaining the fragrance within the storage chamber.

10 Claims, 7 Drawing Sheets

AROMATIC WATER CUP

TECHNICAL FIELD

The present invention relates to the technical field of water cups, and more particularly to an aromatic water cup.

BACKGROUND

A water cup is used for containing beverages, such as drinks or water and other liquids. With the diversification of user needs, water cups are available in many types and shapes, such as household water cups, travel water cups, and sports water cups, among others.

As user demands continue to evolve, users increasingly seek enhanced sensory experiences while drinking from water cups. For example, during the drinking process, users may prefer to smell scents they enjoy, thereby enhancing the overall drinking experience.

In the prior art, the functions of water cups are mostly limited to containing beverages for drinking by users. The functionality is singular, and the user experience is limited, making it difficult to meet the growing demands of users.

SUMMARY

The objective of the present invention is to provide an aromatic water cup, aiming to solve the problem of limited user experience in conventional water cups.

The present invention is implemented as follows: an aromatic water cup comprises a cup body, wherein the cup body has an inner cavity for containing a beverage. The cup body is connected to a cup head, and a cylindrical tube is provided on the cup head. A flow channel that communicates with the inner cavity is formed inside the cylindrical tube, through which the beverage in the inner cavity flows out.

A cup cover is provided on the cup head, and a storage chamber is enclosed between the cup head and the cup cover. An aromatic block that emits fragrance is disposed in the storage chamber.

The cylindrical tube passes through the cup cover, and the storage chamber surrounds the outer periphery of the cylindrical tube. The cup cover is provided with an air outlet hole, through which the fragrance emitted from the aromatic block is discharged. A rotating disk rotatable relative to the cup cover is provided on the cup cover, and the cylindrical tube passes through the rotating disk. The rotating disk is provided with a vent hole.

During the rotation of the rotating disk relative to the cup cover, when the vent hole is aligned with the air outlet hole, the cup cover is in a venting state, and the fragrance emitted from the aromatic block is discharged outward sequentially through the air outlet hole and the vent hole. When the vent hole is misaligned with the air outlet hole, the rotating disk seals the air outlet hole, the cup cover is in a sealed state, and the fragrance emitted from the aromatic block is confined within the storage chamber.

Further, the rotating disk is provided with a plurality of vent holes, which are arranged sequentially and spaced apart along the rotational direction of the rotating disk relative to the cup cover. The diameters of the vent holes decrease sequentially. When the cup cover is in the venting state, only one of the vent holes is aligned with the air outlet hole.

Further, the cup cover is provided with a recessed groove, the rotating disk is movably embedded in the recessed groove, and is rotatably connected with the cup cover.

Further, the cup cover is provided with a plurality of slots, which are arranged circumferentially and spaced apart along the cup cover. The rotating disk is provided with a plurality of latch columns, which are arranged circumferentially and spaced apart along the rotating disk. The latch columns respectively pass through the slots so that the rotating disk and the cup cover are integrally connected. Along the rotational direction of the rotating disk relative to the cup cover, the length of each slot is greater than the length of each latch column.

Further, the cup head protrudes a plurality of columns, which are formed within the storage chamber. The cup cover is provided with a plurality of mounting holes. The columns abut the cup cover and are respectively aligned with the mounting holes. Screws are inserted through the cup cover, passing through the mounting holes and engaging the columns, so that the cup cover is integrally connected with the cup head.

Further, the outer periphery of the aromatic block is provided with a plurality of positioning grooves, and the columns are correspondingly embedded in the positioning grooves, so that the aromatic block is fixed within the storage chamber.

Further, the cup head is provided with an air inlet hole, through which the storage chamber communicates with the inner cavity. A movable plug that moves up and down relative to the cup head is inserted through the cup head. When the movable plug moves upward relative to the cup head, the air inlet hole is sealed, and the storage chamber is isolated from the inner cavity, thereby preventing the beverage in the inner cavity from entering the storage chamber. When the movable plug moves downward relative to the cup head, the air inlet hole is opened, allowing air from the storage chamber to enter the inner cavity.

Further, the cup head is provided with a through hole, and the air inlet hole and the through hole are arranged adjacent to each other. The air inlet hole is arcuately curved along the circumferential direction of the through hole. The movable plug includes a movable rod inserted through the through hole. The upper end of the movable rod is provided with an end head, and the lower end is provided with an elastic sealing cap. The end head and the sealing cap respectively restrict the movable rod from detaching from the through hole.

When the movable rod moves downward relative to the cup head, the sealing cap is separated from the cup head, the air inlet hole is opened, and the storage chamber communicates with the inner cavity via the air inlet hole. When the movable rod moves upward relative to the cup head, the sealing cap abuts the cup head and seals the air inlet hole, thereby isolating the storage chamber from the inner cavity.

Further, an inner chamber is formed in the end head, the inner chamber being spherical in shape. A spherical counterweight ball is disposed within the inner chamber, and the diameter of the counterweight ball is smaller than that of the inner chamber. A rigid rod is embedded inside the movable rod, the rigid rod is coaxially arranged with the movable rod and is enclosed within it.

Further, a protruding ring is formed on the cylindrical tube. The protruding ring is arranged within the flow channel and circumferentially surrounds the flow channel. A step surface facing the inner cavity is formed at the bottom of the protruding ring, which also circumferentially surrounds the flow channel. A buffer channel is provided inside the protruding ring, which axially extends along the flow channel and vertically penetrates through the protruding ring and the step surface.

Compared with the prior art, the aromatic water cup provided by the present invention enables a user, when desiring to drink the beverage from the inner cavity, to rotate the rotating disk to align the vent hole with the air outlet hole. This allows the fragrance emitted by the aromatic block to be discharged outward through the vent hole, putting the cup cover in a venting state. While drinking, the user can smell the fragrance emitted by the aromatic block, thereby enhancing the sensory experience. When the user does not wish to drink, the rotating disk can be turned to misalign the vent hole with the air outlet hole. The cup cover then enters a sealed state, confining the fragrance inside the storage chamber.

DETAILED DESCRIPTION

Figure 1:
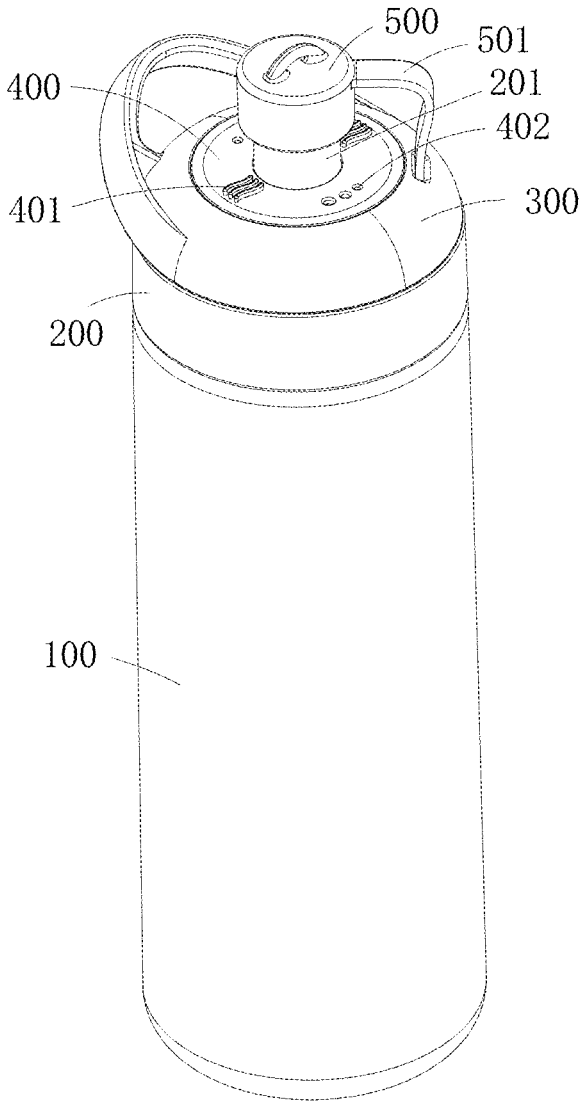
FIG. 1 is a perspective schematic view of the aromatic water cup provided by the present invention.

In order to make the objectives, technical solutions, and advantages of the present invention more apparent, the invention will be described in further detail below with reference to the accompanying drawings and specific embodiments. It should be understood that the specific embodiments described herein are merely illustrative of the invention and are not intended to limit the invention in any way.

The following provides a detailed description of the implementation of the present invention in conjunction with specific embodiments.

In the drawings of the present embodiment, identical or similar reference numerals correspond to identical or similar components. In the description of the present invention, it should be understood that positional or directional terms such as "upper," "lower," "left," "right," etc., are based on the orientation or positional relationship shown in the drawings. These terms are merely for the purpose of describing the invention and simplifying the description, and are not intended to indicate or imply that the referenced device or component must be constructed or operated in a particular orientation. Therefore, the positional terms used in the drawings are for illustrative purposes only and should not be construed as limiting the present patent. Those skilled in the art can interpret these terms appropriately based on the specific context.

Figure 2:
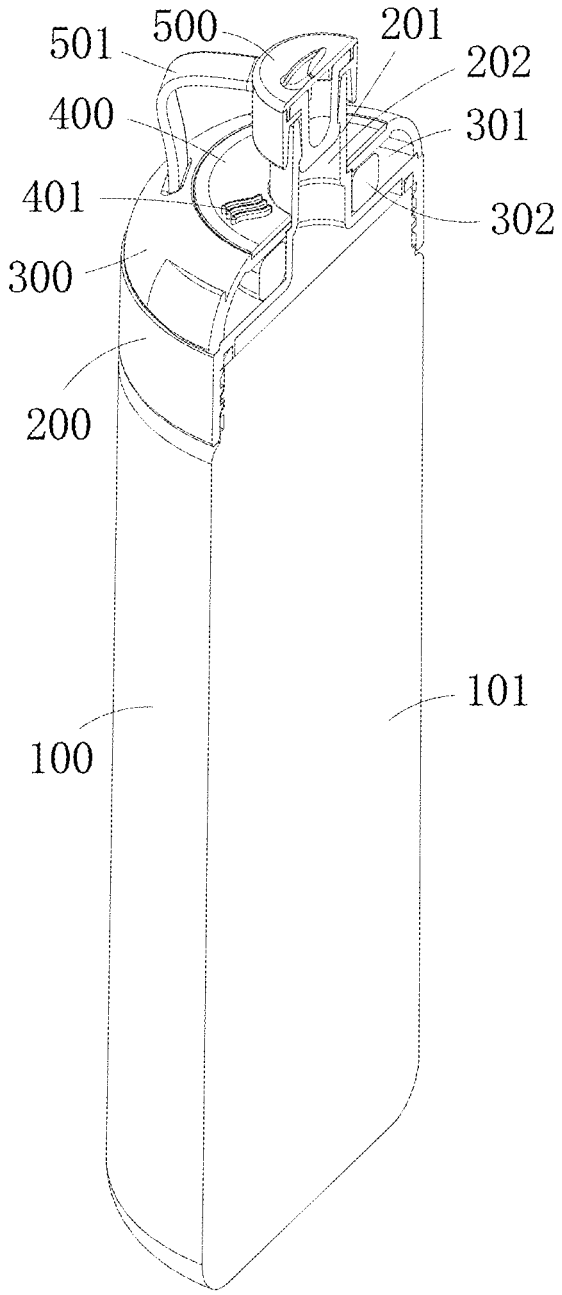
FIG. 2 is a sectional schematic view of the aromatic water cup provided by the present invention.
Figure 3:
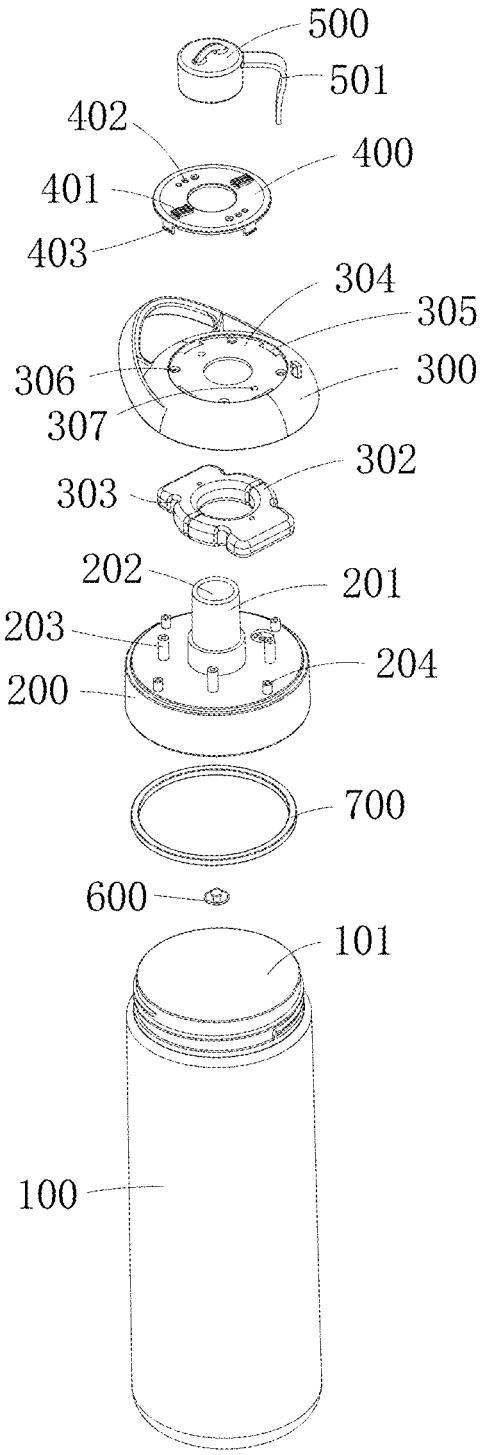
FIG. 3 is an exploded perspective schematic view of the aromatic water cup provided by the present invention.
Figure 4:
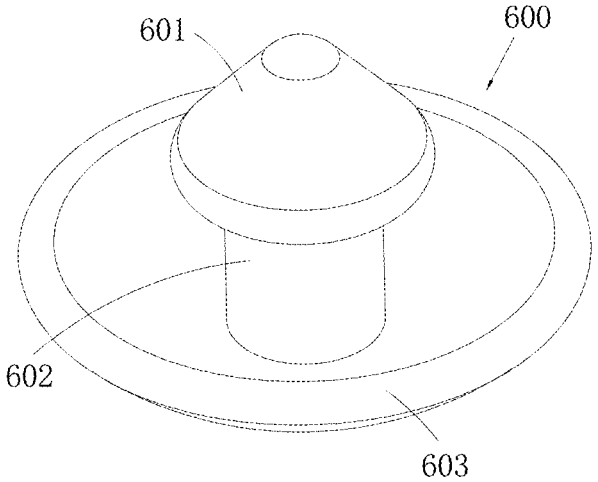
FIG. 4 is a perspective schematic view of the movable plug provided by the present invention.
Figure 5:
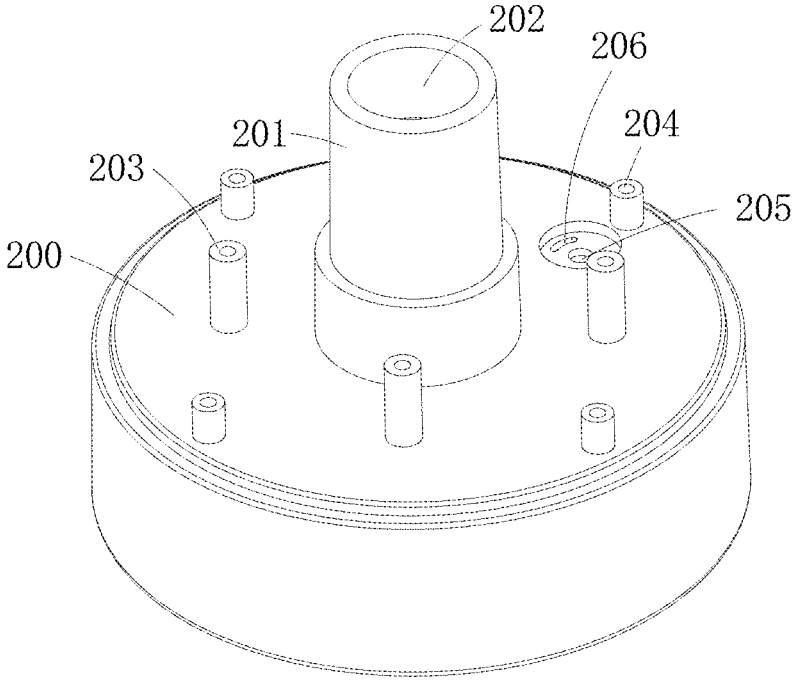
FIG. 5 is a perspective schematic view of the cup head provided by the present invention.
Figure 6:
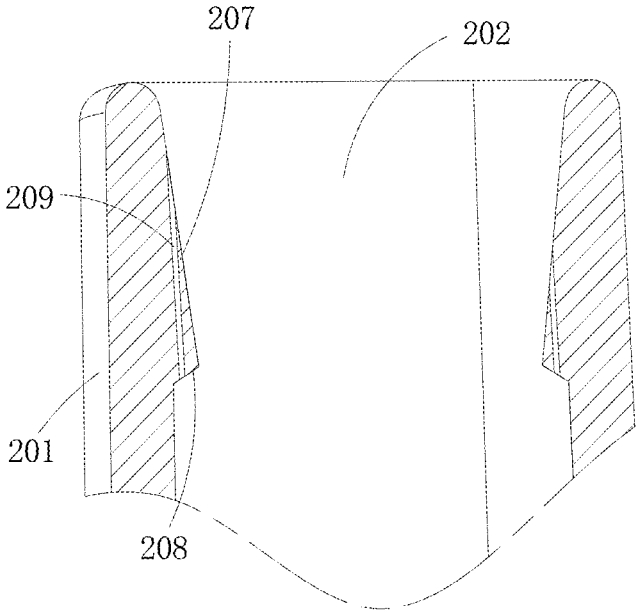
FIG. 6 is a detailed sectional schematic view of the cylindrical tube provided by the present invention.
Figure 7:
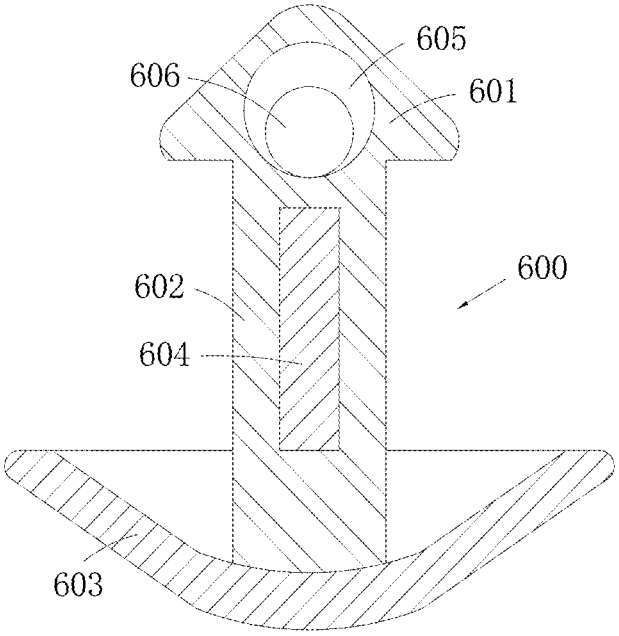
FIG. 7 is a perspective schematic view of the movable plug provided by the present invention.
Figure 8:
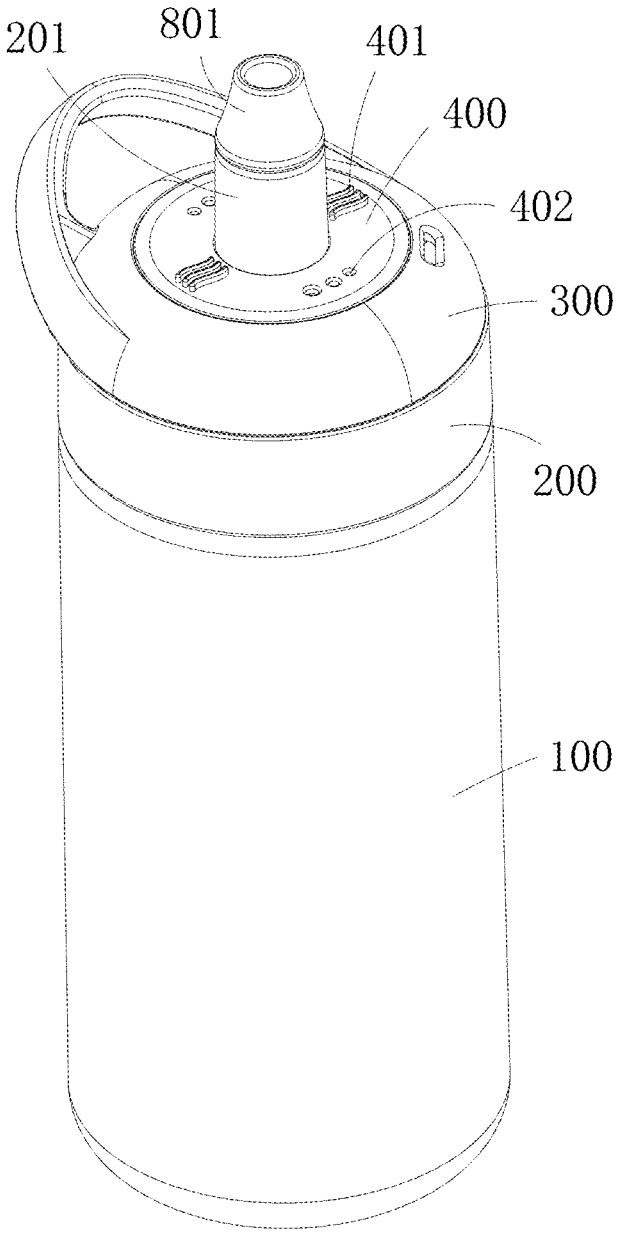
FIG. 8 is a perspective schematic view of the aromatic water cup provided by the present invention with a straw installed.
Figure 9:
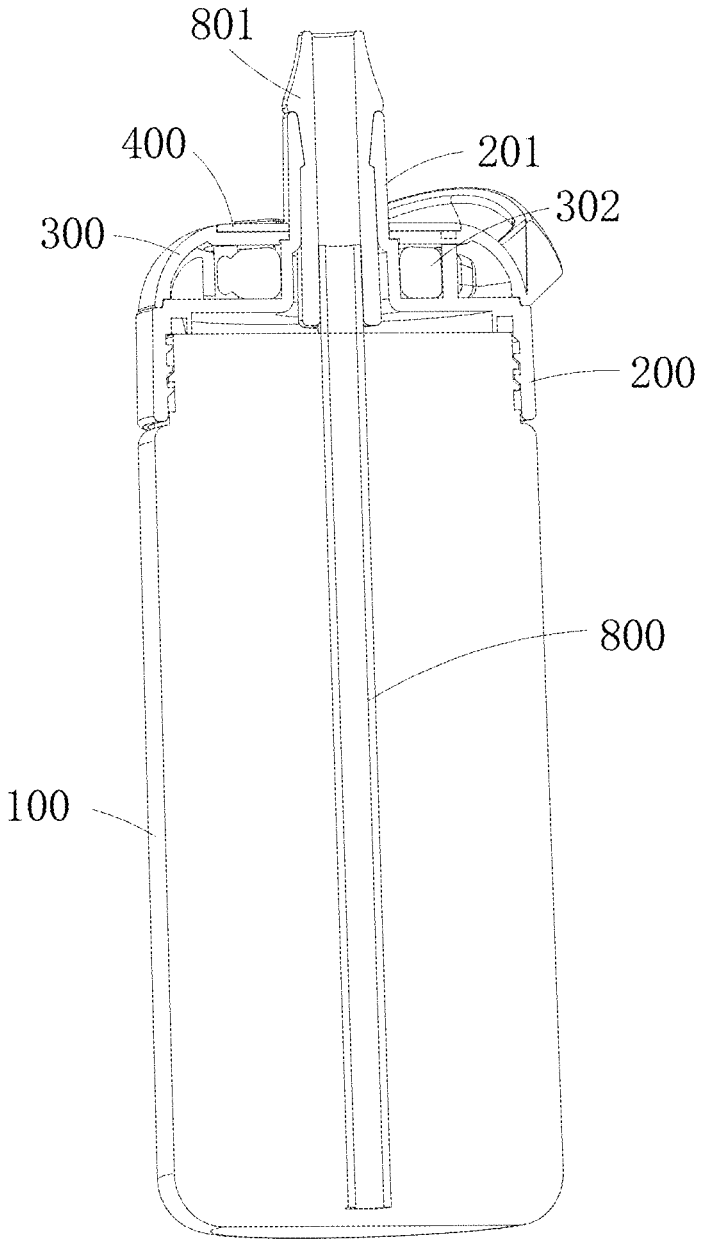
FIG. 9 is a sectional schematic view of the aromatic water cup provided by the present invention with a straw installed.

With reference to FIGS. 1 to 9, a preferred embodiment of the aromatic water cup provided by the present invention is shown.

The aromatic water cup comprises a cup body 100. An inner cavity 101 is formed in the cup body 100 for containing a beverage. The cup body 100 is connected to a cup head 200. A cylindrical tube 201 is provided on the cup head 200. A flow channel 202 communicating with the inner cavity 101 is formed in the cylindrical tube 201, and the beverage in the inner cavity 101 flows out through the flow channel 202. A cup cover 300 is provided on the cup head 200, and a storage chamber 301 is enclosed between the cup head 200 and the cup cover 300. An aromatic block 302 for emitting fragrance is disposed in the storage chamber 301.

The beverage may be any potable liquid, such as plain water, beverages, etc. The cylindrical tube 201 may be straight or curved, and the flow channel 202 matches the shape of the cylindrical tube 201. The aromatic block 302 may be a solid block that emits fragrance, or it may be a cotton body soaked with aromatic liquid. The specific form may vary depending on practical requirements and is not limited to any particular item. Additionally, the fragrance emitted by the aromatic block 302 may be selected based on user preferences, such as fruity scents or other specific aromas.

The cylindrical tube 201 passes through the cup cover 300, and the storage chamber 301 surrounds the outer periphery of the cylindrical tube 201. An air outlet hole 307 is provided on the cup cover 300, through which the fragrance emitted from the aromatic block 302 is released. A rotating disk 400, rotatable relative to the cup cover 300, is also provided on the cup cover 300. The cylindrical tube 201 passes through the rotating disk 400, and the rotating disk 400 is provided with a vent hole 402.

The rotating disk 400 is disposed on the cup cover 300 and can rotate along the plane of the cup cover 300, thereby changing the relative position between the vent hole 402 and the air outlet hole 307.

During the rotation of the rotating disk 400 relative to the cup cover 300, when the vent hole 402 is aligned with the air outlet hole 307, the cup cover 300 is in a venting state. The fragrance emitted from the aromatic block 302 is sequentially discharged through the air outlet hole 307 and the vent hole 402 to the outside. When the vent hole 402 is misaligned with the air outlet hole 307, the rotating disk 400 seals the air outlet hole 307, the cup cover 300 is in a sealed state, and the fragrance emitted from the aromatic block 302 is confined within the storage chamber 301.

In the aromatic water cup provided above, when a user wishes to drink the beverage from the inner cavity 101, the rotating disk 400 is actuated to rotate such that the vent hole 402 is aligned with the air outlet hole 307. The fragrance emitted from the aromatic block 302 can then be released outward through the vent hole 402, and the cup cover 300 enters a venting state. During the drinking process, the user can smell the fragrance emitted by the aromatic block 302, which enhances the drinking experience and overall user satisfaction, thereby meeting user demands.

When the user does not wish to drink the beverage from the inner cavity 101, the rotating disk 400 is rotated such that the vent hole 402 is misaligned with the air outlet hole 307. In this case, the cup cover 300 is in a sealed state, and the fragrance emitted from the aromatic block 302 is confined within the storage chamber 301.

In this embodiment, the storage chamber 301 is arranged in a fully circumferential manner around the outer periphery of the cylindrical tube 201. In this configuration, the aromatic block 302 disposed within the storage chamber 301 can also be arranged in a fully circumferential manner around the cylindrical tube 201, thereby expanding the coverage area of the aromatic block 302 and enabling the fragrance to be diffusely emitted in all directions. When the cup cover 300 is in the venting state, continuous outward release of the fragrance is ensured.

In this embodiment, the rotating disk 400 is provided with a plurality of vent holes 402, which are arranged sequentially and spaced apart along the rotational direction of the rotating disk 400 relative to the cup cover 300. The diameters of the plurality of vent holes 402 gradually decrease in sequence. When the cup cover 300 is in the venting state, only one vent hole 402 is aligned with the air outlet hole 307.

The area of alignment between the vent hole 402 and the air outlet hole 307 determines the amount of fragrance released outward. According to personal preference, the user can rotate the rotating disk 400 to select a corresponding vent hole 402 to align with the air outlet hole 307, thereby adjusting the amount of fragrance emitted. This design meets the diverse needs of users and provides them with more customizable options.

In this embodiment, the cup cover 300 is provided with a recessed groove 304. The rotating disk 400 is movably embedded in the recessed groove 304 and rotatably connected to the cup cover 300. In this manner, the rotating disk 400 is fitted with the cup cover 300 and can be hidden within the recessed groove 304.

Additionally, to facilitate rotation of the rotating disk 400, the rotating disk 400 is provided with a plurality of ribs 401. The ribs 401 are arranged side by side with spacing between them, and the length direction of each rib 401 is oriented perpendicular to the rotational direction of the rotating disk 400. When the user needs to rotate the rotating disk 400, they may press their finger against one or more of the ribs 401 to apply force, thereby driving the rotating disk 400 to rotate.

In this embodiment, the cup cover 300 is provided with a plurality of slots 305, which are arranged circumferentially and spaced apart along the perimeter of the cup cover 300. The rotating disk 400 is provided with a plurality of latch columns 403, which are also arranged circumferentially and spaced apart along the rotating disk 400. The latch columns 403 respectively pass through the corresponding slots 305, thereby integrally connecting the rotating disk 400 with the cup cover 300. Along the rotational direction of the rotating disk 400 relative to the cup cover 300, the length of each slot 305 is greater than the length of each latch column 403.

Once the latch columns 403 pass through the corresponding slots 305, the rotating disk 400 is movably connected to the cup cover 300 as an integral unit. The latch columns 403 engage with the cup cover 300 and restrict the rotating disk 400 from detaching from the cup cover 300. In addition, because the length of each slot 305 is greater than that of each latch column 403, the rotating disk 400 can rotate within a limited range relative to the cup cover 300.

The rotation range of the rotating disk 400 relative to the cup cover 300 is defined by the lengthwise direction of the slots 305. During the rotation of the rotating disk 400 relative to the cup cover 300, when a latch column 403 abuts the end of a corresponding slot 305, the rotating disk 400 reaches its rotational limit. Within this range of rotation, the cup cover 300 can be in either a venting state or a sealed state. When in the venting state, the cup cover 300 may be adjusted as needed so that a specific vent hole 402 aligns with the air outlet hole 307.

In this embodiment, the cup head 200 protrudes a plurality of columns 203, which are formed inside the storage chamber 301. The cup cover 300 is provided with a plurality of mounting holes 306. The columns 203 abut the cup cover 300 from below and are aligned with the mounting holes 306. Screws are inserted through the cup cover 300 and pass through the mounting holes 306 to engage with the columns 203, thereby integrally connecting the cup cover 300 with the cup head 200.

During assembly of the cup head 200 and the cup cover 300, the cup cover 300 is mounted onto the cup head 200. The plurality of columns 203 abut the cup cover 300 from below, and the plurality of mounting holes 306 are aligned with the columns 203. Screws are inserted through the mounting holes 306 into the columns 203 and threadingly engage with the columns 203, thereby achieving the connection between the cup cover 300 and the cup head 200.

To facilitate positioning during assembly of the cup cover 300 and the cup head 200, in this embodiment, the cup head 200 is provided with a plurality of positioning posts 204. The positioning posts 204 are circumferentially arranged around the cylindrical tube 201 at intervals. After the cup cover 300 is mounted onto the cup head 200, the positioning posts 204 are correspondingly inserted into the cup cover 300, achieving positioning of the cup cover 300. At this point, the columns 203 are also aligned with the mounting holes 306.

In this embodiment, the outer periphery of the aromatic block 302 is provided with a plurality of positioning grooves 303. The columns 203 are correspondingly embedded in the positioning grooves 303, thereby fixing the aromatic block 302 within the storage chamber 301. After the aromatic block 302 is placed in the storage chamber 301, the columns 203 are embedded into the positioning grooves 303 to circumferentially restrict the aromatic block 302 along its periphery, thus securing it within the storage chamber 301 and preventing any shaking or dislodgment during use.

When it is necessary to replace the aromatic block 302, the columns 203 can be disengaged from the positioning grooves 303, thereby allowing removal of the aromatic block 302 and replacement with a new one.

In this embodiment, the cup head 200 is provided with an air inlet hole 206. The storage chamber 301 communicates with the inner cavity 101 via the air inlet hole 206. A movable plug 600, which moves vertically relative to the cup head 200, is inserted through the cup head 200. When the movable plug 600 moves upward relative to the cup head 200, the air inlet hole 206 is sealed, and the storage chamber 301 is isolated from the inner cavity 101, preventing the beverage in the inner cavity 101 from entering the storage chamber 301. When the movable plug 600 moves downward relative to the cup head 200, the air inlet hole 206 opens, allowing air from the storage chamber 301 to enter the inner cavity 101 through the air inlet hole 206.

In this embodiment, the cup head 200 is provided with a through hole 205. The air inlet hole 206 is arranged adjacent to and spaced apart from the through hole 205. The air inlet hole 206 is arcuately curved along the circumferential direction of the through hole 205. This configuration increases the air intake area of the air inlet hole 206 and, when the storage chamber 301 communicates with the inner cavity 101, enlarges the communication area between the two chambers.

The movable plug 600 includes a movable rod 602 that is movably inserted through the through hole 205. The diameter of the movable rod 602 is smaller than that of the through hole 205. The upper end of the movable rod 602 is provided with an end head 601, and the lower end is provided with an elastic sealing cap 603. The end head 601 and the sealing cap 603 restrict the movable rod 602 from detaching from the through hole 205.

The diameters of the end head 601 and the sealing cap 603 are both larger than that of the through hole 205. Thus, once the movable rod 602 is inserted into the through hole 205, the end head 601 and the sealing cap 603 prevent the rod from slipping out. Since the diameter of the movable rod 602 is smaller than the through hole 205, the movable rod 602 can move vertically within the through hole 205.

When the movable rod 602 moves downward relative to the cup head 200, the sealing cap 603 is separated from the cup head 200, and the air inlet hole 206 is in an open state. At this point, the storage chamber 301 communicates with the inner cavity 101 through the air inlet hole 206. Simultaneously, the end head 601 seals the through hole 205 from above, while the sealing cap 603 is separated from the cup head 200 from below, allowing the air inlet hole 206 to remain open.

When the movable rod 602 moves upward relative to the cup head 200, the sealing cap 603 abuts against the cup head 200, sealing the air inlet hole 206 and isolating the storage chamber 301 from the inner cavity 101. Meanwhile, the end head 601 is separated upward from the cup head 200, and the sealing cap 603 engages the cup head 200 from below, thereby sealing both the through hole 205 and the air inlet hole 206.

When the cup body 100 is in an upright position, or when its tilt angle is less than a predefined threshold, the air inlet hole 206 remains open. In this state, the air mixed with fragrance inside the storage chamber 301 flows into the inner cavity 101 through the air inlet hole 206, allowing the fragrance to mix with the beverage inside the inner cavity 101. Moreover, the pressure inside the inner cavity 101 and the storage chamber 301 remains consistent with atmospheric pressure, thereby facilitating the outflow of the beverage through the flow channel 202. This allows the user to easily drink the beverage from the inner cavity 101 while enjoying the added fragrance, enhancing the overall sensory experience.

Additionally, when the user is drinking the beverage, or when the tilt angle of the cup body 100 exceeds a predetermined threshold, the air inlet hole 206 is in a closed state. This prevents the beverage in the inner cavity 101 from entering the storage chamber 301, and the beverage in the inner cavity 101 flows out only through the flow channel 202 of the cylindrical tube 201.

In this embodiment, an internal cavity 605 is provided within the end head 601. The internal cavity 605 is spherical in shape and contains a spherical counterweight ball 606. The diameter of the counterweight ball 606 is smaller than that of the internal cavity 605, allowing the counterweight ball 606 to roll within the internal cavity 605. Depending on the tilt angle of the movable plug 600, the counterweight ball 606 can roll within the internal cavity 605 to produce a counterbalancing effect. A rigid rod 604 is embedded inside the movable rod 602. The rod 604 is coaxially arranged with the movable rod 602 and is enclosed within it.

When the cup body 100 is in an upright position, or when its tilt angle is less than the predetermined angle, the counterweight ball 606 rests at the bottom of the internal cavity 605, and the end head 601 seals the through hole 205, keeping the air inlet hole 206 in an open state. When the tilt angle of the cup body 100 exceeds the predetermined threshold, the counterweight ball 606 rolls in response to the inclination, accelerating and pulling the movable plug 600 to move such that the sealing cap 603 abuts the cup body 100 and seals both the air inlet hole 206 and the through hole 205. Due to the counterweight effect of the counterweight ball 606, the sealing function of the sealing cap 603 is more reliably achieved.

Additionally, the rod 604 is made of a rigid material. When the movable rod 602 moves within the through hole 205, the rod 604 helps prevent bending or deformation of the movable rod 602, thereby avoiding jamming during movement and ensuring smooth vertical travel of the movable rod 602 within the through hole 205.

In this embodiment, the cup head 200 is threadably connected to the cup body 100. Thus, by rotating the cup head 200, it can be detached from or connected to the cup body 100. To ensure a sealed connection between the cup body 100 and the cup head 200, a sealing ring 700 is disposed between them.

In this embodiment, the cylindrical tube 201 is provided with a protruding ring 207. The protruding ring 207 is formed within the flow channel 202 and is circumferentially arranged along the flow direction. A stepped surface 208 is formed at the bottom of the protruding ring 207, facing the inner cavity 101 and circumferentially extending along the flow channel 202. A buffer channel 209 is provided within the protruding ring 207. The buffer channel 209 extends axially along the flow channel 202, passing vertically through the protruding ring 207 and through the stepped surface 208.

When the user tilts the cup body 100 and drinks the beverage through the flow channel 202 of the cylindrical tube 201, the beverage in the inner cavity 101 flows out along the flow channel 202. At this moment, the protruding ring 207 provides partial blockage within the flow channel 202, thereby buffering the flow speed of the beverage and preventing excessive flow that could lead to spillage.

Additionally, a buffer channel 209 is formed within the protruding ring 207. While the stepped surface 208 performs a blocking and buffering function on the beverage, the beverage can flow through the buffer channel 209 and pass through the protruding ring 207. In this way, the protruding ring 207 not only buffers the beverage flow but also performs a dispersing and guiding function, preventing overflow caused by excessive flow rate and avoiding interruption of beverage flow.

In this embodiment, a cap 500 is connected to the cup cover 300. The cap 500 is attached to the cup cover 300 by a connecting strap 501. When the user does not need to drink, the cap 500 can be placed over the cylindrical tube 201, thereby sealing the flow channel 202 of the cylindrical tube 201. When the user needs to drink the beverage in the inner cavity 101, the cap 500 can be removed from the cylindrical tube 201, thus opening the flow channel 202. Due to the constraint provided by the connecting strap 501, the cap 500 will not be lost or dropped.

Alternatively, for easier access to the beverage in the inner cavity 101, a straw 800 may be provided within the inner cavity 101. The straw 800 includes a straw head 801, which is inserted into the flow channel 202 of the cylindrical tube 201 and fixedly connected to the cylindrical tube 201. The straw head 801 extends outward from the cylindrical tube 201, allowing the user to directly sip the beverage from the inner cavity 101 through the straw head 801.

The foregoing description merely illustrates a preferred embodiment of the present invention and is not intended to limit the scope of the invention. Any modifications, equivalent substitutions, or improvements made within the spirit and principle of the invention shall fall within the scope of protection of the present invention.

The invention claimed is:

1. An aromatic water cup, comprising:

a cup body provided with an inner cavity for containing a beverage;

a cup head connected to the cup body;

a cylindrical tube disposed on the cup head, the cylindrical tube comprising a flow channel in communication with the inner cavity, wherein the beverage in the inner cavity flows out through the flow channel;

a cup cover disposed on the cup head, wherein a storage chamber is enclosed between the cup cover and the cup head;

an aromatic block disposed in the storage chamber for emitting fragrance;

wherein the cylindrical tube passes through the cup cover, and the storage chamber surrounds an outer periphery of the cylindrical tube;

an air outlet hole formed on the cup cover, through which the fragrance emitted from the aromatic block is released outward;

a rotating disk rotatably connected to the cup cover, the cylindrical tube passing through the rotating disk, and the rotating disk being provided with a vent hole;

wherein, during rotation of the rotating disk relative to the cup cover, when the vent hole is aligned with the air outlet hole, the cup cover is in a venting state and the fragrance is sequentially released outward through the air outlet hole and the vent hole; and when the vent hole is misaligned with the air outlet hole, the rotating disk seals the air outlet hole, the cup cover is in a sealed state, and the fragrance is retained within the storage chamber.

2. The aromatic water cup of claim 1, wherein the rotating disk is provided with a plurality of vent holes, which are sequentially and spacedly arranged along a rotation direction of the rotating disk relative to the cup cover, and wherein the diameters of the plurality of vent holes progressively decrease; and when the cup cover is in the venting state, only one of the vent holes is aligned with the air outlet hole.

3. The aromatic water cup of claim 1, wherein the cup cover is provided with a recessed groove, and the rotating disk is movably embedded in the recessed groove and rotatably connected to the cup cover.

4. The aromatic water cup of claim 1, wherein the cup cover is provided with a plurality of slots, which are circumferentially spaced apart along the cup cover;

the rotating disk is provided with a plurality of latch columns, which are circumferentially spaced apart along the rotating disk;

each of the latch columns passes through a corresponding one of the slots, so that the rotating disk is integrally connected to the cup cover;

and a length of each slot in a rotation direction of the rotating disk relative to the cup cover is greater than a length of each latch column.

5. The aromatic water cup of any one of claim 4, wherein the cup head protrudes a plurality of columns formed within the storage chamber;

the cup cover is provided with a plurality of mounting holes, each of the columns abutting the cup cover and aligned with one of the mounting holes;

and a screw is inserted through each of the mounting holes and connected to a corresponding one of the columns, so that the cup cover is integrally connected to the cup head.

6. The aromatic water cup of claim 5, wherein an outer periphery of the aromatic block is provided with a plurality of positioning grooves, and the columns are correspondingly embedded in the positioning grooves so as to fix the aromatic block within the storage chamber.

7. The aromatic water cup of any one of claim 4, wherein the cup head is provided with an air inlet hole through which the storage chamber communicates with the inner cavity;

a movable plug is movably inserted through the cup head and vertically movable relative to the cup head;

when the movable plug moves upward relative to the cup head, the air inlet hole is closed, the storage chamber is isolated from the inner cavity, and flow of the beverage from the inner cavity into the storage chamber is prevented;

when the movable plug moves downward relative to the cup head, the air inlet hole is opened, and air from the storage chamber enters the inner cavity through the air inlet hole.

8. The aromatic water cup of claim 7, wherein the cup head is provided with a through hole adjacent to and spaced from the air inlet hole, the air inlet hole being arcuately curved along a circumferential direction of the through hole;

the movable plug comprises a movable rod movably inserted through the through hole, the movable rod having an end head at an upper end and an elastic sealing cap at a lower end;

the end head and the sealing cap restrict the movable rod from detaching from the through hole;

wherein when the movable rod moves downward relative to the cup head, the sealing cap is separated from the cup head, the air inlet hole is opened, and the storage chamber communicates with the inner cavity through the air inlet hole;

and when the movable rod moves upward relative to the cup head, the sealing cap abuts the cup head to seal the air inlet hole, thereby isolating the storage chamber from the inner cavity.

9. The aromatic water cup of claim 8, wherein the end head is provided with a spherical internal cavity, and a spherical counterweight ball is disposed within the internal cavity, the counterweight ball having a diameter smaller than that of the internal cavity;

and a rigid rod is embedded inside the movable rod, coaxially arranged therewith and enclosed within the movable rod.

10. The aromatic water cup of any one of claim 4, wherein the cylindrical tube is provided with a protruding ring formed within the flow channel and circumferentially arranged along the flow channel;

a stepped surface facing the inner cavity is formed at a bottom of the protruding ring and circumferentially arranged along the flow channel;

and a buffer channel is provided in the protruding ring, extending axially along the flow channel and vertically penetrating the protruding ring and the stepped surface.

* * * * *